United States Patent [19]

Eistrat

[11] 4,290,261

[45] * Sep. 22, 1981

[54] NON-SPECULAR ELECTRICAL CONDUCTOR AND STEEL STRAND, AND METHODS OF MAKING

[76] Inventor: Thomas Eistrat, 1020 S. Almansor St., Alhambra, Calif. 91801

[ * ] Notice: The portion of the term of this patent subsequent to Apr. 17, 1996, has been disclaimed.

[21] Appl. No.: 141,028

[22] Filed: Apr. 17, 1980

Related U.S. Application Data

[63] Continuation-in-part of Ser. No. 12,168, Feb. 14, 1979, Pat. No. 4,198,807, which is a continuation-in-part of Ser. No. 869,850, Jan. 16, 1978, Pat. No. 4,149,367.

[51] Int. Cl.[3] ..... D07B 7/14

[52] U.S. Cl. ..... 57/223; 57/7; 57/217; 57/232

[58] Field of Search ..... 57/1, 6, 7, 8, 9, 13, 57/212, 217, 221, 223, 232, 241, 248, 250, 258, 292, 295, 296, 309, 314; 174/128 R, 130 R

[56] References Cited

U.S. PATENT DOCUMENTS

| | | | |
|---|---|---|---|
| 1,798,316 | 3/1931 | Dreisbach | 57/210 X |
| 2,042,824 | 6/1936 | Brazier | 57/232 X |
| 2,071,709 | 2/1937 | Riddle | 57/311 X |
| 3,053,039 | 9/1962 | Demmel | 57/295 |
| 3,061,997 | 11/1962 | Haugwitz . | |
| 3,124,927 | 3/1964 | Mann et al. | 57/9 |
| 3,217,838 | 11/1965 | Peterson et al. . | |
| 3,413,792 | 12/1968 | Werdenberg | 57/9 |
| 3,496,285 | 2/1970 | Slethei | 174/130 |
| 3,526,530 | 9/1970 | Sams | 427/170 X |
| 3,760,093 | 9/1973 | Pemberton | 174/128 X |
| 3,761,346 | 9/1973 | Caroselli et al. | 57/248 X |
| 3,899,365 | 8/1975 | Guy | 57/314 X |
| 3,906,672 | 9/1975 | Kobayashi | 51/410 |

*Primary Examiner*—Donald Watkins

[57] ABSTRACT

Each wire of bare stranded electrical conductor and wire rope when supported outdoors is constantly sliding and rubbing against each adjacent wire in the stranded article due to temperature changes and wind induced vibrations. If the articles are made non-specular or dulled by abrasive blasting the completely stranded article, abrasive particles are entrapped on the interior wires and may cause premature wear and failure of the article. Articles are made non-specular or dulled without abrasive blasting by electrostatic cloud fogging or other methods that only affect the visible surface of the outer wires in the completely stranded article. Overhead supported stranded articles are made non-specular or dulled to reduce visibility because of public demand.

10 Claims, 2 Drawing Figures

NON-SPECULAR ELECTRICAL CONDUCTOR AND STEEL STRAND, AND METHODS OF MAKING

This is a continuation-in-part of applicant's Ser. No. 12,168, filed Feb. 14, 1979, now U.S. Pat. No. 4,198,807, which in turn is a continuation-in-part of applicant's Ser. No. 869,850, filed Jan. 16, 1978, now U.S. Pat. No. 4,149,367.

Each is incorporated herein by reference thereto as essential material.

BACKGROUND OF THE INVENTION

1. Field of the Invention

See above incorporated documents.

2. Description of Prior Art

See above incorporated documents.

SUMMARY OF THE INVENTION

It is a primary object of this invention to provide a novel and improved stranded electrical and or steel strand of many advantageous properties and attributes, and unique methods of producing same.

It is also an object of this invention to provide a new multi-layered uncovered stranded non-specular dulled electrical conductor and or a steel strand that does not contain abrasive grits or other contaminants entrapped during manufacture on one or more interior layers within the multi-layered articles of manufacture.

It is also an object of this invention to provide a new multi-layered non-specular-dulled spray-painted stranded electrical conductor and or steel strand that does not contain paint entrapped during manufacture on one or more interior layers within the multi-layered articles of manufacture. years service life testing necessary to insure such service life before multi-layered uncovered stranded non-specular dulled electrical conductor is installed in overhead outdoor transmission and distribution lines. More than 300 million pounds and thousands of miles of non-specular dulled transmission and distribution lines have been erected nationwide during the past 10 years; and all contain abrasive grits trapped within interior strands of aforesaid non-specular multi-layered conductor; and all aforesaid have been installed nationwide without any service life testing.

This invention combines the art known to those with ordinary skill in the electrophoresis and electrostatic industrial painting and fogging arts with the art of those with ordinary skill in the multi-layered uninsulated electrical conductor manufacturing art to make as part of this invention a new article of manufacture, a multi-layered uncovered stranded, about American National Standard, C 7.69, dulled non-specular conductor with the top layer of strands non-specular and each of one or more interior layers free of any of the matter used for making the non-specular dulling on the outer layer of strands.

Additional parts of this invention are the methods of making this new unique conductor. The methods are to non-specularly dull the outer layer of strands after cleaning and stranding them by applying a dulling pigment by electrophoresis or electrostatic processes. The non-specular dulling can be uniformly applied without allowing the pigment to penetrate to any of the interior layers of the multi-layered conductor by not having cleaned the interior layers of strands of wire drawing lubricants and by coordinating the rate of pulling the conductor and the intensity of electrical potential with either the electrophoresis or electrostatic processes.

The foregoing electrophoresic or electrostatic processes for conductor are equally applicable to steel strand.

The processes also include non-specular dulling the visible surface of the outer layer by spray painting.

It is known by those with ordinary skill in the specific arts of anodizing, electrostatic, electrophoresic, and spray painting depostion that each is a distinct and separate from the other. It is also known by those with ordinary skill in these separate arts that there are different means freely used for the same arts. For example, one designation for electrodeposition is electrostatic deposition, others are electrostatic coating, electrostatic powder coating, electric cloud coating, or electrostatic painting. Another designation for electrodeposition is electrophoresic with organic coatings. There are various names for anodizing. Spray painting may be air or airless, and is always distinguished from anodizing and electrodeposition. Anodizing is always distinguished from electrodeposition.

Exterior, outer, and top layer as used herein have the same meaning.

Heretofore used abrasive grit blasting for non-specular dulling of stranded articles having exterior and interior layers had abrasive grit contaminated interior layers while this invention herein and the patents incorporated herein by reference for a non-specular dulling on the exterior layer are without contaminated interior layers. The electrodeposition to non-specular or dull the outer layer of strands may be made before or after stranding the outer layer through the cable or wire mill closing block and is just sufficient fogging to obtain an American National Standard C 7.69 reflectance.

BRIEF DESCRIPTION OF THE DRAWING

Referring to FIG. 1, reference block 1 designates bobbins filled with bright surface finished strand on the cable strander for the top layer of a multi-layered non-specular conductor. Block 2 designates all the layers of strands on the cable strander below the top layer. Block 3 designates the final closing block on the cable strander. Block 4 designates an electrophoresis or electrostatic process comprising assurance of cleaning the exposed exterior of the top layer of strands, deposition of a non-specular dulling pigment to give a reflectance of about American National Standard C-7.69-1976, and drying same. Block 5 designates the reel upon which the non-specular dulled mult-layered conductor is wound after completion of the non-specular dulling.

Referring to FIG. 2, reference Block 1 designates bobbins filled with bright surface finished wire strand before it is cleaned of wire drawing compound. Block 6 designates bright surface finished wire strand in bobbins after it has been cleaned by solvent such as trichlorethylene and placed on the cable strander for the top layer of a non-specular multi-layered conductor. Block 2 designates all layers of strands on the cable strander below the top layer before entering the top layer closing block. Block 3 designates the top and final closing block on the cable strander, which block will not have a lubricant that would require recleaning the top strand before the non-specular dulling process of electrophoresis or electrostatic process of Block 4. Block 4 designates an electrophoresis or electrostatic process comprising deposition of a non-specular dulling pigment to about a ANS C-7.69 reflectance, and drying same. Block 5 designates the reel upon which the non-specular dulled multi-layered conductor is wound after completion of the non-specular dulling.

DESCRIPTION OF A PREFERRED EMBODIMENT

Figure 1:
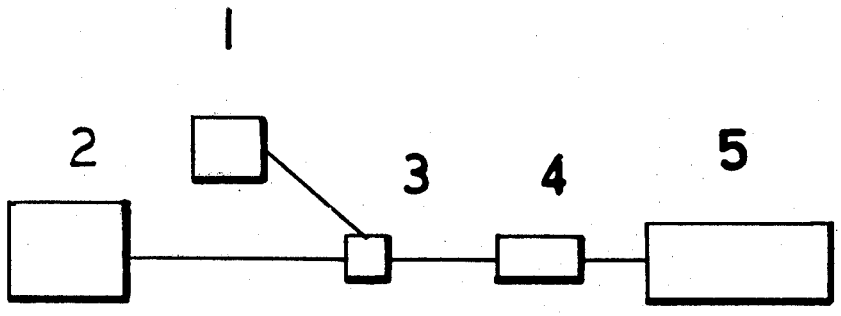
FIG. 1 comprises a block diagram of an embodiment of this invention on a cable strander in a wire mill.
Figure 2:
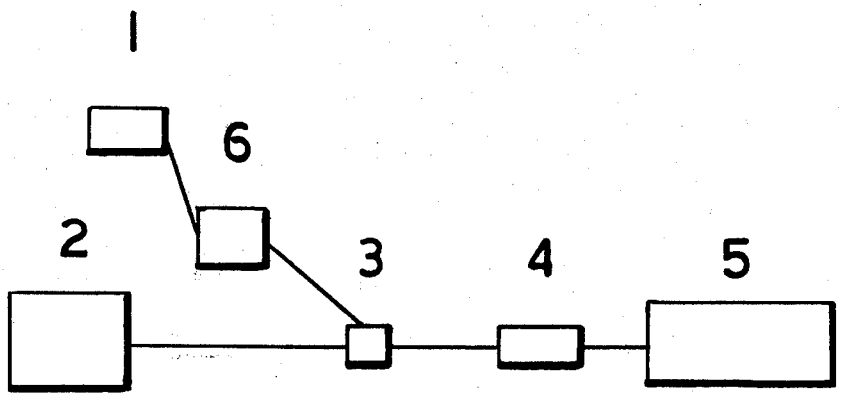
FIG. 2 comprises a block diagram of another embodiment of this invention on a cable strander in a wire mill.

The preferred embodiment is that described in FIG. 1 of the brief description of the drawing.

Although American National Standard C7.69 for NON-SPECULAR SURFACE FINISH ON BARE OVERHEAD ALUMINUM CONDUCTORS stated herein as a standard for the non-specular finish of articles of this invention, it is to be understood that the matte, non-specular gray finish of ANS C 7.69 although generally a preferred embodiment, there are backgrounds in overhead distribution and transmission line installations where non-specular other than gray finish may be desirable—and such is within the scope of this invention. Likewise, although not specifically mentioned, the scope of this invention includes conductors of metals other than aluminum such as copper, and conductors composed of more than one metal.

Although conductors are one of the principal objects of this invention, it can be seen that non-specular multi-layered stranded steel wire products in the fields stated in U.S. Pat. No. 4,198,807 are equally within the scope of this invention.

This invention having been described in its preferred embodiments, it is clear that it is susceptible to numerous modifications and embodiments within the ability of those skilled in the art and without the exercise of the inventive faculty. Accordingly, the scope of this invention is defined by the scope of the following claims.

What is claimed:

1. A multi-layered stranded linear body having interior and exterior wires, such as an electrical conductor or wire rope, wherein the improvement comprises;

(a) the exterior wires having an electrodeposited pigment on the surfaces thereof which gives a non-specularly dulled appearance and the exterior wires being stranded over one or more interior wires;

(b) all said interior wires being free of any contaminants such as the products of abrasive blasting.

2. The article of manufacture as in claim 1 further comprising: having an electrostatically deposited pigment as the non-specular dulling of the outer layer.

3. The article of manufacture as in claim 1 further comprising: having an electrophoresically deposited pigment as the non-specular dulling of the outer layer.

4. A multi-layered stranded linear body having interior and exterior wires, such as an electrical conductor or wire rope, wherein the improvement comprises;

(a) the exterior wires having an electrodeposited paint on the surfaces thereof which gives a non-specularly dulled appearance and the exterior wires being stranded over one or more interior wires;

(b) all said interior wires being free of paint and any other contaminants such as the products of abrasive blasting.

5. The process of making the article of claim 4 which comprises: electrostatically depositing a paint as the non-specular dulling on the outer layer strands.

6. The article of manufacture of claim 1, further comprising: the article is an electrical conductor.

7. The article of manufacture of claim 1, further comprising: the article is a steel wire product.

8. A process of making a multi-layered stranded linear body having contaminant free interior and exterior wires and having a non-specular appearance comprising the steps of:

(a) providing a contaminant free stranded linear body;

(b) applying a dulling coating to the exterior wires by electrodepositing a pigment thereon.

9. The process as defined in claim 8 wherein said electrodepositing step includes electrostatic deposition of said pigment.

10. The process as defined in claim 8 wherein said electrodepositing step includes electrophoresical deposition of said pigment.

* * * * *

UNITED STATES PATENT AND TRADEMARK OFFICE

CERTIFICATE OF CORRECTION

PATENT NO. : 4,290,261

DATED : September 22, 1981

INVENTOR(S) : Thomas Eistrat

It is certified that error appears in the above—identified patent and that said Letters Patent is hereby corrected as shown below:

Column 1, line 36, before the word "years" add the following omitted words which begin the sentence and new paragraph:

-- It is also an object of this invention to eliminate 30 or more --.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*